United States Patent [19]

Oyarzabal

[11] Patent Number: 4,966,367

[45] Date of Patent: Oct. 30, 1990

[54] BALL STRIKING PRACTICE APPARATUS

[76] Inventor: Hector A. Oyarzabal, 11130 Vance Jackson, Apt. 1402, San Antonio, Tex. 78230

[21] Appl. No.: 399,078

[22] Filed: Aug. 28, 1989

[51] Int. Cl.[5] ..... A63B 69/40

[52] U.S. Cl. ..... 273/26 E; 273/29 A; 273/58 C; 273/413

[58] Field of Search ..... 273/26 E, 26 EA, 29 A, 273/58 C, 413

[56] References Cited

U.S. PATENT DOCUMENTS

| | | | |
|---|---|---|---|
| 1,554,409 | 9/1925 | Coffee | 273/26 E |
| 1,708,796 | 4/1929 | Lawrence . | |
| 2,247,072 | 6/1941 | Stow | 273/29 A |
| 2,270,957 | 1/1942 | Mears . | |
| 4,027,880 | 6/1977 | Hadtke . | |
| 4,088,316 | 5/1978 | Szafianski . | |
| 4,138,107 | 2/1979 | Janis | 273/29 A |
| 4,216,960 | 8/1980 | Nicholls . | |
| 4,322,075 | 3/1982 | Hynes | 273/26 E |
| 4,462,599 | 7/1984 | Brown . | |
| 4,576,379 | 3/1986 | Juhasz . | |
| 4,735,413 | 4/1988 | Yamanouchi et al. | 273/58 C |

*Primary Examiner*—Theatrice Brown

*Attorney, Agent, or Firm*—Hubbard, Thurman, Turner, Tucker

[57] ABSTRACT

A ball striking practice apparatus comprises a lower anchor means, an upper anchor means and an intermediate anchor means horizontally spaced relative to the aforementioned anchor means but defining therewith a vertical plane which normally is bisected by the body of the person utilizing the practice device. A practice ball is positioned between the aforementioned three anchor elements by three elastic cords. The ball is diametrically traversed by a wire having looped ends on the exterior of the ball which provide anchoring means at the top and bottom surfaces of the ball. A horizontal, radially disposed wire is inserted into the ball and has a hooked end engaging the center of the diametrical wire. The radially disposed wire defines a looped end exteriorly of the ball and positioned radially intermediate the top and bottom loop ends. Each of the looped ends. Each of the bolt elements defines an anchor for one of the elastic cords and the three elastic cords are respectively secured to the lower anchor means, the upper anchor means and the intermediate anchor means to thereby position the ball for striking by a player. The ball will rapidly return to its initial position without engaging in a flight path that would threaten the player after the practice ball is hit.

5 Claims, 2 Drawing Sheets

BALL STRIKING PRACTICE APPARATUS

BACKGROUND OF THE INVENTION

1. Field of the Invention:

This invention relates to a portable practice ball positioning device which enables a person to practice repetitively striking a practice ball located at one of a plurality of vertically preset locations, resulting in a realistic resistance and flight of the struck ball and a quick dampened return of the object to the same location.

2. Prior Art:

Applicant is aware of the following prior publications relating to practice ball positioning and return devices;

U.S. Pat. No. 4,576,379 to JUHASZ, Mar. 18, 1986

U.S. Pat. No. 4,462,599 to BROWN, July 31, 1984

U.S. Pat. No. 4,216,960 to NICHOLLS, Aug. 12, 1980

U.S. Pat. No. 4,088,316 to SZAFIANSKI, May 9, 1979

U.S. Pat. No. 4,027,880 to HADTKE, June 7, 1977

U.S. Pat. No. 2,270,957 to MEARS, Jan. 27, 1942

U.S. Pat. No. 2,247,072 to STOW, June 24, 1941

U.S. Pat. No. 1,708,796 to LAWRENCE, Apr. 9, 1929

Heretofore, practice ball striking positioning devices have failed to provide portability and to duplicate the normal stroking position of the user or a realistic feel and flight of an object when impacted. The tennis tuner in patent #4,027,880 to HADTKE provided a ball attached to a combination of horizontal elastic and inelastic cords which necessarily require the striker to straddle one of the cords, thus preventing practice on a high positioned practice ball.

The practice devices disclosed in patent #4,088,316 to SZAFIANSKI, and patent #2,247,072 to STOW, restrain the struck object along only one axis, in this case the vertical axis. There is a substantial danger that the return flight of the ball will fly directly toward the striker. If the ball is hard, like a baseball, injury can result.

The practicing device in patent #2,270,957 to MEARS is also restrained along a single axis, requires attachment to a permanent structure, and although the resistance may be varied by movement of the person, does not permit realistic movement of the person during the striking motion or a static resistance to the struck ball. Additionally, this device does not provide the ability to selectively position the ball along the vertical axis for different strokes.

Tethered apparatus such as patent #4,576,379 to JUHASZ, patent #4,462,599 to BROWN, patent #4,216,960 to NICHOLLS, and patent #1,708,796 to LAWRENCE all merely suspend a ball from a tether but do not provide neither the feel, flight, safety nor dampening advantages of the present invention.

SUMMARY OF THE INVENTION

The invention contemplates providing a portable stand having a generally horizontal base portion, a generally vertical post or riser portion and a horizontal top portion. Cord anchoring means are provided on the lower base portion and on the horizontal top portion and these two cord anchoring means are in generally vertical alignment. An intermediate cord anchoring means is provided at any selected position on the vertical riser portion of the portable apparatus.

A practice ball is provided having two cord anchors secured to the ball in diamtrically spaced relationship and these elements are secured by elastic cords to the upper and lower cord anchor means. A third cord anchor is provided on the ball in 90° spaced relationship between the other two cord anchoring devices and this third cord anchor is connected by an elastic cord to the intermediate cord anchoring means provided on the vertical riser element of the apparatus. Each of the cords are connected to their respective anchor means by adjustable length springs so that the length and the tension of the cords may be conveniently adjusted. Thus, the vertical position of the practice ball may be at substantially any elevation between the bottom cord anchoring means and the top cord anchoring means.

A significant feature of the invention is the fact that the three aforedescribed cord anchors define a vertical plane which normally bisects a portion of the body of the user of the device when he is properly positioned for making a stroke at the practice ball.

OBJECTS AND ADVANTAGES

Ball practicing devices of the type herein are useful in improving one's skill in games which involve the striking of an object such as a baseball, softball, tennis ball, hand ball, racket ball or shuttlecock with a striking instrument such as a racket, bat stick, or one's hand. It is the object of the invention herein to provide a portable positioning device which permits a person to engage in the repetitive striking of such object at a plurality of preset vertical positions in a relatively confined location so as to tone the required muscles, develop muscle memory of the proper motion, and develop the proper execution of the striking motion. For illustrative purposes herein the striking instrument will be referred to as a racket and the struck object as a ball, both of the type commonly used in the game of tennis, although many variations of the striking and struck object could be used.

Muscle memory occurs when a particular motion is repeated a sufficient number of times with accompanying realistic sensations to verify the proper execution of the motion so as to enable a person to precisely reenact the motion when called upon in a competitive setting. In actual competition, the feel of striking the ball, the flight of the ball, and the location of landing of the ball all verify the proper execution of the striking motion. In a game such as tennis, a number of motions are required as a result of the location and speed of the returning tennis ball. Each motion is accompanied by different sensations imparted when striking the ball.

Therefore, an object of the present invention is to provide an apparatus to permit hitting the ball from a normal striking position to simulate realistic resistance and flight of the ball after being struck, and return the ball quickly to substantially the same location where it was struck. An additional object is to provide the capability of adjusting the vertical location of the practice ball to permit practice of the basic swings in tennis. A further objective is to precisely orient the ball to minimize undesirable contact between the periphery of the striking instrument and the securing cords and insure consistent feel and flight of the ball. The apparatus claimed herein may be self-supported which allows the device to be easily moved from location to location without requiring attachment to an adjoining structure or the ground. Additionally, means are provided which allows for adjustment for the slack or play in the securing cords which results after repeated use of the positioning device.

Further objects and advantages will be readily apparent to those skilled in the art from the following detailed description, taken in conjunction with the annexed sheet of drawings on which is shown a preferred embodiment of the invention.

DESCRIPTION OF PREFERRED EMBODIMENT

Figure 1:
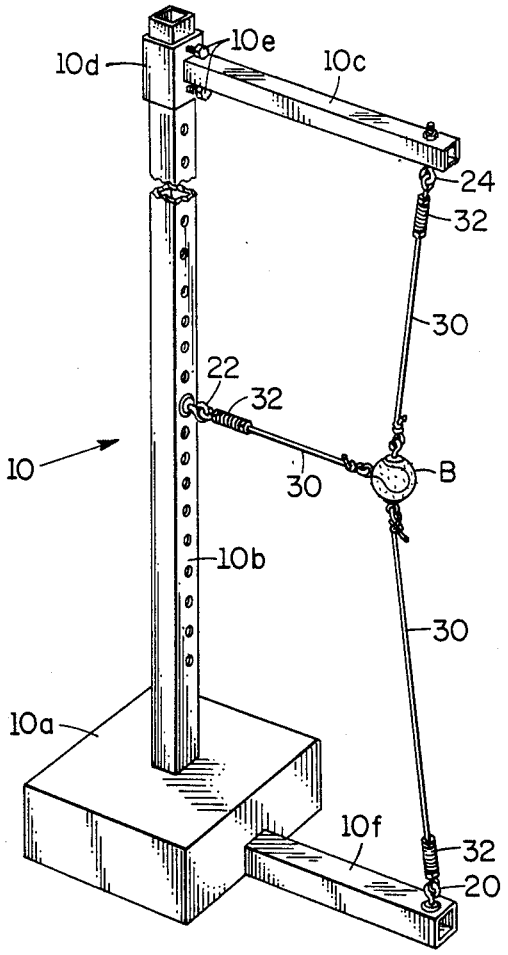
FIG. 1 is a front perspective view of an apparatus embodying this invention.

In all modifications of apparatus embodying this invention, three flexible cord anchoring points are provided in vertically spaced relationship. There is a lower anchoring point normally positioned close to the ground, an upper anchor point which is preferably positioned at a location above the highest stroke that would be made at a practice ball and an intermediate anchor point which is horizontally displaced from the upper and lower anchor points. These anchor points may conveniently use the side wall of a building, for the intermediate anchor point, a building overhang for the upper anchor point and an anchor bolt driven into the ground to provide the lower anchor point. Preferably, however, the three anchor points are defined on a portable apparatus 10 as shown in the drawings. The apparatus 10 comprises a base portion 1O*a*, an upstanding riser or post portion 1O*b*, and a horizontal top portion 1O*c* overlying the base portion and secured to riser 10*b* by a sleeve 1O*d* and bolts 10*e*. The lower anchor point can then comprise a hook 20 secured to a horizontal projection 10*f* formed on the base portion 1O*a*, a second hook 22 (or plurality of hooks) secured at any selected vertical position along the riser 1O*b*, and a hook 24 provided in the horizontal top portion 10*c* in generally vertical alignment with the lower anchor point defined by the hook 20.

Figure 3:
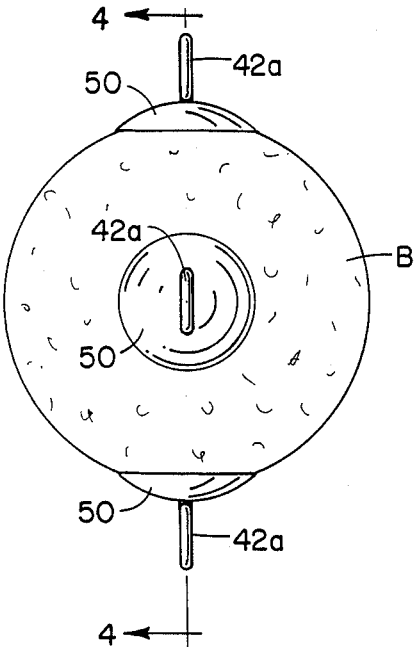
FIG. 3 is an elevational view of the practice ball.
Figure 4:
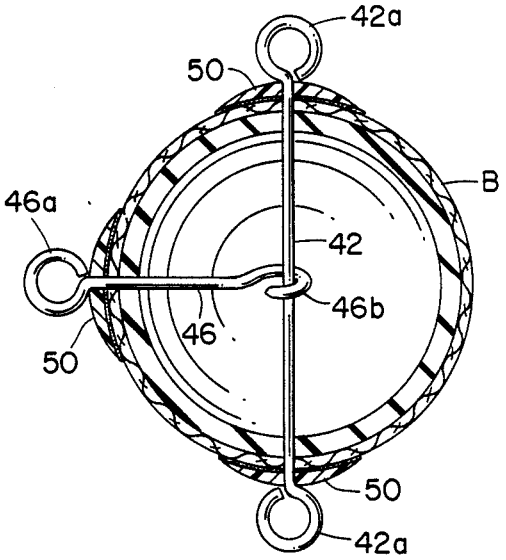
FIG. 4 is a vertical sectional view of the practice ball.

A practice ball B is then positioned intermediate the three anchor points by three elastic cords 30. The elastic cords may be of the type described in detail in several of the aforementioned prior art patents. Each cord 30 is secured at one end to the practice ball B. One cord extends to the lower anchor hook 20, a second cord extends to an intermediate anchor hook 22, and a third cord extends to the top upper anchor hook 24. The practice ball B may be positioned in any selected one of a plurality of vertical positions by tying the three ends of the vertical cords to provide a selected length. Adjustable length spring units 32 are preferably provided intermediate the ends of each of the anchor cords and the aforementioned anchor points so that the tension in the cords may be conveniently adjusted. The elastic cords may be secured to the practice ball B by plastic pads which overlie the ends of the cords and are adhesively secured to the periphery of the practice ball. In the preferred embodiment of this invention, however, the elastic cords 30 are secured to the ball in the manner indicated in FIGS. 3 and 4. Thus, a light weight securing wire 42 diametrically traverses the ball in a vertical direction and the projecting ends are formed into anchor loops 42*a* which secure wire 42 to the ball. A second wire 46 is provided and its length is substantially equal to the radius of the ball. Wire 46 has a hook-shaped portion 46*b* engagable with the diametrical wire 42. After such engagement the outer end of wire 46 is bent into an anchor loop 46*a* which bears against the periphery of ball B to secure wire 46 in snug engagement with wire 42. Preferably, a disc-shaped elastomeric sealing washer 50 is provided beneath each of the wire loops 42*a* and 46*a* so that the pressure normally maintained within a ball, such as a tennis ball, may be restored by a pump having a needle type discharge element and maintained therein by such sealing washers.

The respective elastic cords 30 are inserted through loops 42*a* and 46*a* and the respective cords tied to such loops.

Figure 2:
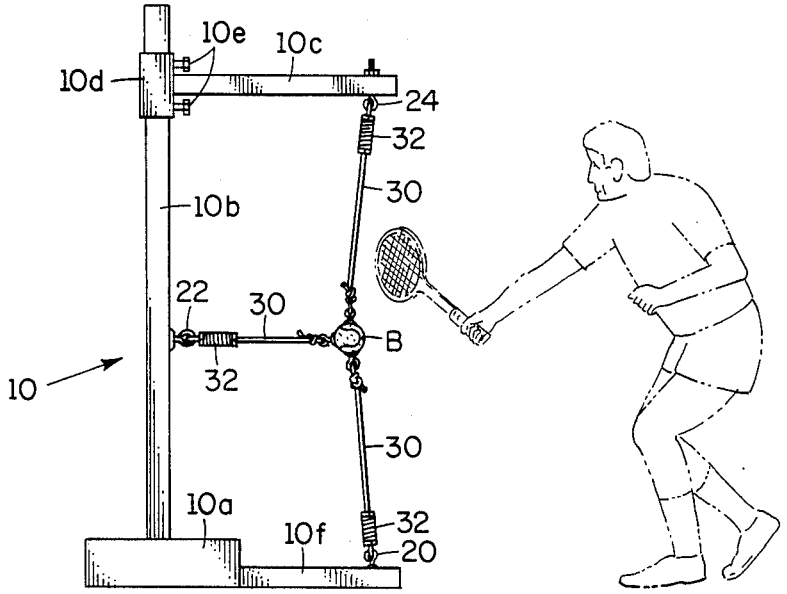
FIG. 2 is a side elevational view of FIG. 1 with the position of a player shown in dotted lines.

From the foregoing description, it will be apparent that the intermediate anchor hook 22 cooperates with the top and bottom anchor hooks 20 and 24 to define a vertical plane which normally bisects the body of the user of the practicing device, as schematically indicated in FIG. 2. Thus, the user is not encumbered by the presence of the elastic cords and can take a proper position relative to the practice ball to make a proper stroke. When the ball is hit, the fact that a third restraining cord extends from the ball to the intermediate support provides an important advantage for the apparatus. Not only is the ball more rapidly returned to its quiescent position, but it is substantially assured that if the ball swings outwardly, it will not return on a path that would intersect the body of the user of the device. When a hard ball, such as a baseball or handball is used as a practice ball, this can be a source of significant danger to the user of conventional apparatus.

Obviously, by adjusting the length of the vertical cords, and selectively changing the position of the intermediate anchor hook 22, the practice ball may be positioned at any desired vertical height so that a full variety of strokes may be practiced. This is particularly helpful in practicing tennis, racket ball or handball where many different vertical positions of the ball must be encountered and a proper stroking motion developed for each such position.

Although the invention has been described in terms of a specific embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A captive ball apparatus for practice purposes comprising:

A lower cord anchor means, an upper cord anchor means and an intermediate cord anchor means horizontally disposed from and vertically intermediate said lower and upper cord anchor means;

said three cord anchor means defining a vertical plane that will substantially bisect the body of a practicer facing said three cord anchor means and located on the horizontally opposite side of said lower and upper cord anchor means than said intermediate cord anchor means;

a practice ball; and elastic cords respectively secured at one end to said practice ball and at the other end to said lower, upper and intermediate cord anchor means, thereby suspending said practice ball in said vertical plane at a selected height determined by the effective lengths of said elastic cords extending to said lower and upper cord anchor means.

2. The apparatus of claim 1 further comprising:

a free standing vertically extending frame;

said frame having a base portion mounting said lower cord anchor means, a vertical portion mounting said intermediate cord anchor means, and a top portion overlying said base portion and mounting said upper cord anchor means.

3. The apparatus of claim 1 wherein an adjustable length spring is mounted intermediate said lower, upper and intermediate anchor means and the respective elastic cord.

4. The apparatus of claim 1 wherein said practice ball comprises:

a spherical element corresponding in size, appearance and elasticity to a ball actually used for playing;

a first wire vertically traversing said practice ball and having a loop formed on each exposed end for respectively securing two of said elastic cords;

a second wire horizontally traversing said practice ball, the inner end of said second wire being secured to the center of said vertical wire; and a loop formed on the outer end of said second wire for securing said third elastic cord.

5. The apparatus of claim 4 further comprising seal elements surrounding the outer ends of said first and second wires beneath the loops thereof to maintain the customary air pressure within the practice ball.

* * * * *